US008172316B2

(12) United States Patent
Gamboa

(10) Patent No.: US 8,172,316 B2
(45) Date of Patent: May 8, 2012

(54) STACKABLE CHAIR

(76) Inventor: Gustavo G. Gamboa, Tinley Park, IL (US)

( * ) Notice: Subject to any disclaimer, the term of this patent is extended or adjusted under 35 U.S.C. 154(b) by 0 days.

(21) Appl. No.: 13/171,709

(22) Filed: Jun. 29, 2011

(65) Prior Publication Data

US 2011/0254326 A1 Oct. 20, 2011

Related U.S. Application Data

(63) Continuation-in-part of application No. 12/639,511, filed on Dec. 16, 2009.

(60) Provisional application No. 61/275,189, filed on Aug. 26, 2009.

(51) Int. Cl.
*A47C 7/62* (2006.01)

(52) U.S. Cl. ..... 297/188.14; 297/239; 297/451.12

(58) Field of Classification Search ..... 297/188.14, 297/239, 451.11, 451.12
See application file for complete search history.

(56) References Cited

U.S. PATENT DOCUMENTS

| | | | | |
|---|---|---|---|---|
| 3,233,940 | A * | 2/1966 | Tooley, Jr. | 297/188.18 |
| 4,798,413 | A * | 1/1989 | Capelli | 297/161 |
| D361,915 | S * | 9/1995 | Zinnbauer | D6/501 |
| 5,641,197 | A * | 6/1997 | Springmann | 297/188.11 |
| 6,059,357 | A * | 5/2000 | Peart | 297/173 |
| 6,439,659 | B1 * | 8/2002 | Neubauer, Jr. | 297/188.01 |
| 6,840,574 | B1 * | 1/2005 | Wu | 297/45 |
| 7,243,991 | B2 * | 7/2007 | Ojeda | 297/188.14 |
| 7,530,632 | B2 * | 5/2009 | Kaloustian et al. | 297/188.14 |
| 2006/0138814 | A1 * | 6/2006 | Burbrink | 297/188.14 |
| 2010/0301644 | A1 * | 12/2010 | Adams et al. | 297/183.1 |

* cited by examiner

*Primary Examiner* — Peter R. Brown
(74) *Attorney, Agent, or Firm* — Schiff Hardin LLP

(57) ABSTRACT

In a stackable chair system, a plurality of chairs are provided, each chair having a back, a seat, and first and second armrests all integral with one another in an injection-molded thermal plastic construction. Each first armrest has an integral molded round cup-holder positioned in a region of an outer end of the first armrest. Each second armrest has an integral molded second round cup-holder positioned in a region of an outer end of the second armrest. Each seat portion is contoured downwardly forming a seat depression. Each chair is dimensioned so that the chairs can be stacked on top of one another in nested fashion.

19 Claims, 2 Drawing Sheets

26
11B
42
41
18

11A
25A
44
43
17
24A 11A
43
44
27A
17

11B
41
42
25B
24B
22
12
39
40
18

11B
27B
41
42
12
40
39
18

STACKABLE CHAIR

RELATED APPLICATION

The present application is a continuation-in-part of U.S. patent application titled: "Stackable Chair," U.S. Ser. No. 12/639,511 filed Dec. 16, 2009, inventor Gustavo G. Gamboa, which claims the benefit of the filing date of U.S. provisional patent application titled: "Stackable Chair", Ser. No. 61/275,189 filed Aug. 26, 2009, inventor Gustavo G. Gamboa.

BACKGROUND

The preferred embodiments relate generally to a stackable chair and, more particularly, the preferred embodiments of the invention relate to a stackable chair featuring two respective molded cup-holders built into a left-hand armrest and a respective right-hand armrest, and a plate-holder also built into the right-hand armrest.

Inexpensive, molded plastic lawn or patio chairs are used for outdoor events and gatherings. These stackable, one-piece chairs have become standard equipment for consumer households as well as a wide variety of organizations, institutions, and establishments ranging from bars and caterers to schools and churches. The molded stackable chairs are lightweight and inexpensive, easy to move and store, and quite durable for the price. But, when used for events at which food and drink are served and consumed, the standard design of such chairs comes up short. Attempting to enjoy a plate of barbecue and a soft drink while sitting in such a chair, the guest must hold the plate in his or her lap, and either hold the drink or set it on the ground. As a result, drinks and plates get spilled, guests' clothing gets soiled, and the entire event becomes less enjoyable than it might have been.

SUMMARY

In a stackable chair system, a plurality of chairs are provided, each chair having a back, a seat, and first and second armrests all integral with one another in an injection-molded thermal plastic construction. Each first armrest has an integral molded round cup-holder positioned in a region of an outer end of the first armrest. Each second armrest has an integral molded second round cup-holder positioned in a region of an outer end of the second armrest. Each seat portion is contoured downwardly forming a seat depression. Each chair is dimensioned so that the chairs can be stacked on top of one another in nested fashion.

DESCRIPTION OF THE PREFERRED EMBODIMENTS

Figure 2:
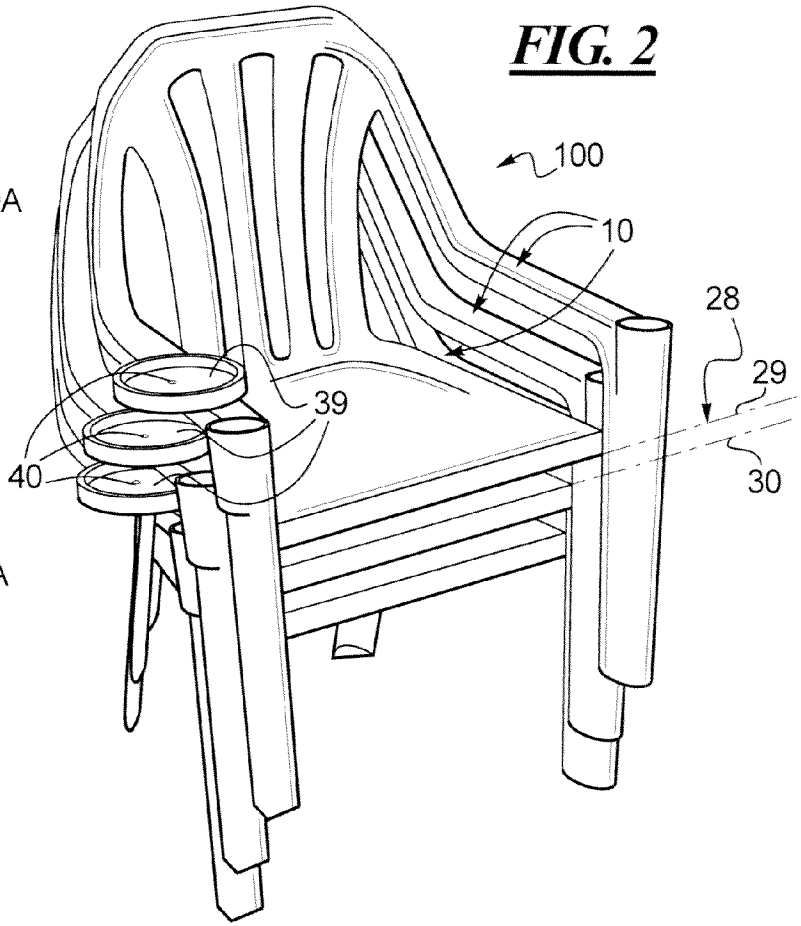
FIG. 2 is a perspective view of a stack of the stackable chairs according to the preferred embodiment of FIG. 1.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

Figure 1:
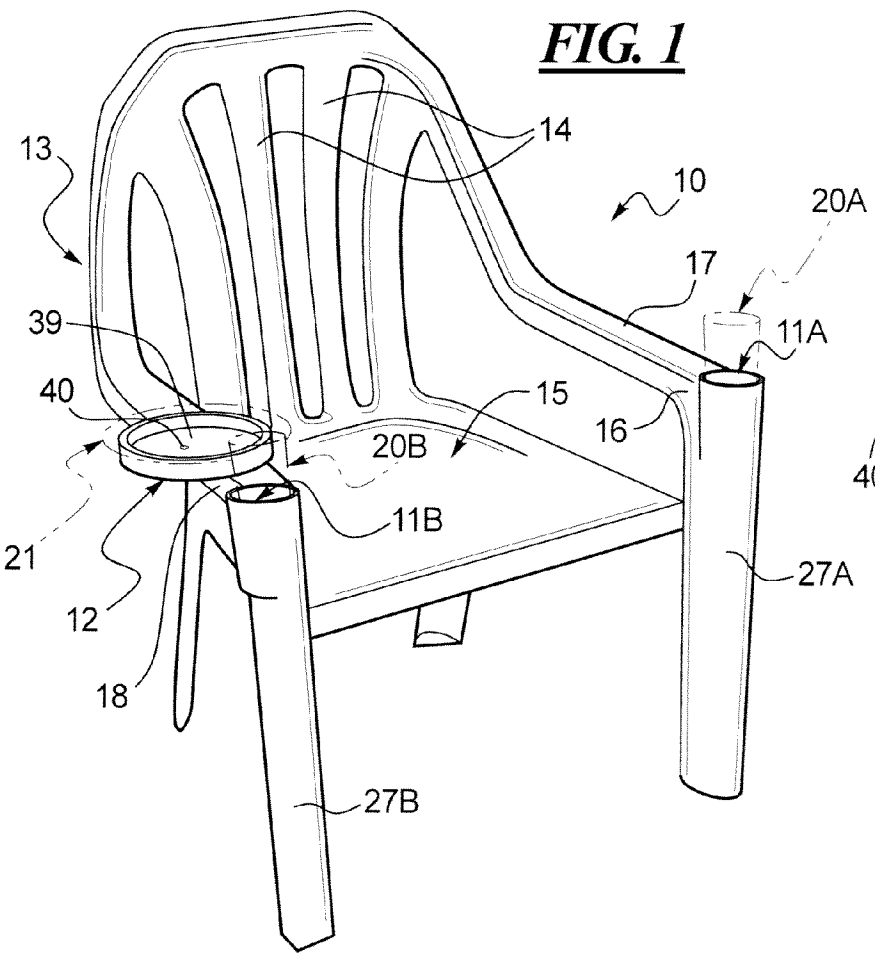
FIG. 1 is a perspective view illustrating a stackable chair, constructed in accordance with a preferred embodiment.

As illustrated in FIG. 1, the present preferred embodiment is a stackable chair for greater versatility.

As more particularly shown in FIG. 1, the stackable chair 10 of the present preferred embodiment is a one-piece, molded plastic, stackable upright patio or lawn chair, similar in design and construction to those found in common use throughout the country, but incorporating design features making the chair unique and far more useful and versatile than the standard chair. The stackable chair 10 features a first molded beverage or cup-holder 11A built into the left-hand armrest 17 for receiving a cup 20A and a plate-holder 12 built into the right-hand armrest 18 for holding a plate 21 along with a second molded beverage cup-holder 11B also built into the right-hand armrest 18 for receiving a cup 20B. Cups 20A and 20B could be different cups or the same cup placed in the second cup-holder 118 instead of the first cup-holder.

The stackable chair 10 of the present preferred embodiment is approximately three (3') feet in height, with a width of two (2') feet and a depth of two (2') feet; a one-piece, injection-molded thermoplastic construction which is weatherproof and UV-resistant, sturdy and durable; a rounded or angular chair back 13 with stylish slats 14, and a contoured, comfortable seat 15. At the end 16 of the left armrest 17, the stackable chair features the cup-holder 11A or 11B which is at least two (2") inches but preferably four and one-half (4½") inches in depth, with a width of at least two inches (2") and preferably about three (3") inches, and designated to hold a beer or soft-drink bottle or can, or a Styrofoam or plastic picnic cup 20A or 20B.

The chair's right armrest 18 molded plate-holder 12 is at least four (4") inches but preferably six (6") inches in diameter, and has a flat bottom and has a depth of at least (1") inch but preferably two (2") inches for accommodating and securing a paper, plastic, or Styrofoam picnic plate 21. An edge of the plate-holder nearest a leading front edge of the right armrest is at least two inches (2") rearwardly of a front of the right armrest.

Figures 3, 4, 5, 6, 7:
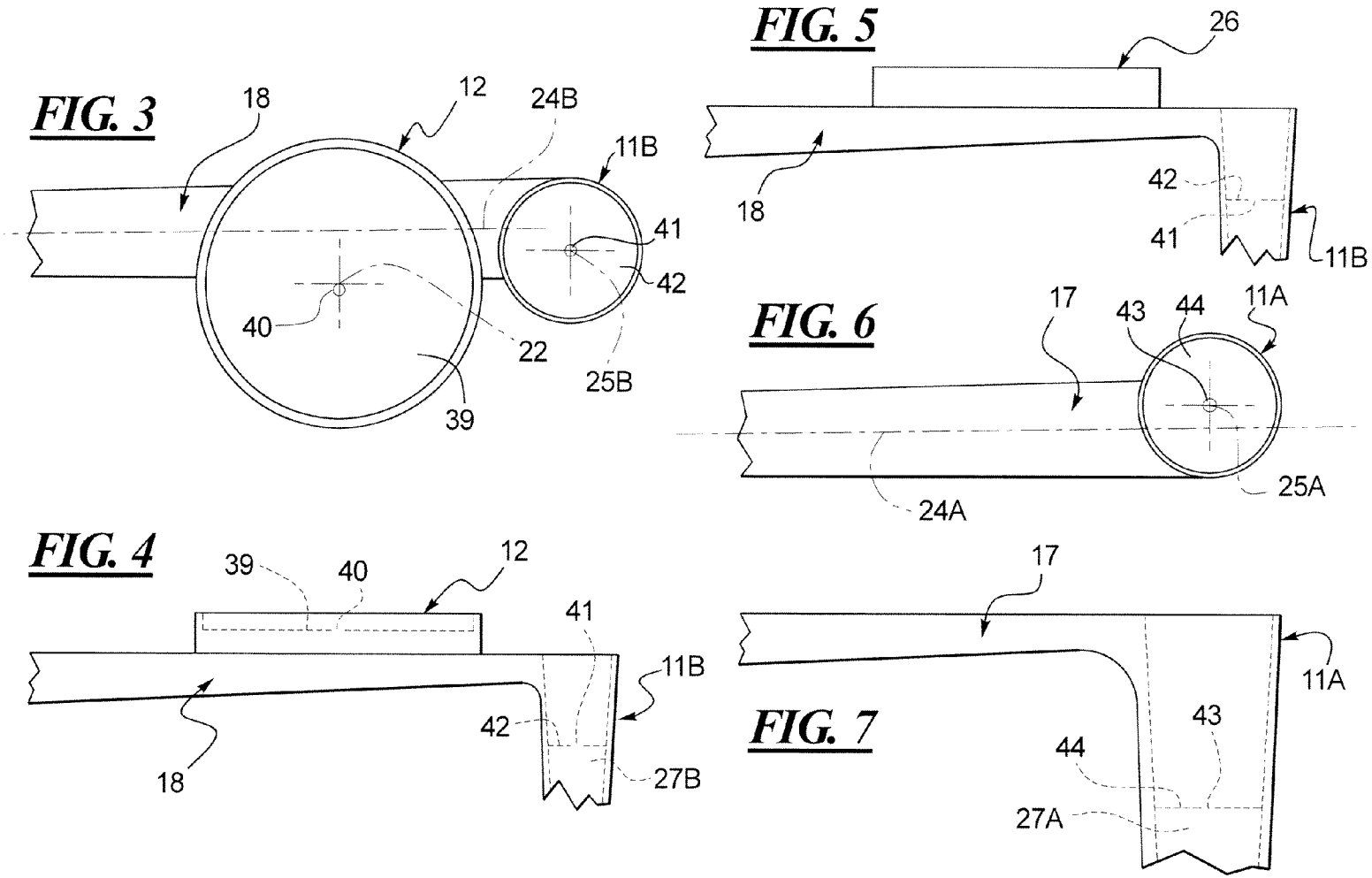
FIG. 3 is a top partial view of a plate-holder and a second cup-holder in FIG. 1.
FIG. 4 is a side partial view of the plate-holder and the second cup-holder of FIG. 1.
FIG. 5 is a side partial view of an alternative plate-holder.
FIG. 6 is a top partial view of a first cup-holder in FIG. 1.
FIG. 7 is a side partial view of the first cup-holder of FIG. 1

Both of the cup-holders 11A and 11B, and the plate-holder 12, are positioned laterally toward the outer sides of the two armrests. As to the plate-holder 12, when viewed from the top as shown in FIG. 3, it may be observed that the central vertical axis 22 of the plate-holder 12 is outwardly of the longitudinal center line 24B of the armrest 18 by at least one-half inch (½") and preferably one inch (1"). And as to the cup-holders 11A and 11B, as shown in FIGS. 3 and 6, with respect to a longitudinal center line 24A or 24B of the armrest 17 or 18, a central vertical axis 25A or 25B of the cup-holder 11A or 11B is outwardly offset by at least one-half (½") inch from this longitudinal center line 24A or 24B.

The floor 39 of a plate holder 12 has a rain water drain hole 40. Similarly the cup-holder 11B has a rain water drain hole 41 in the floor 42 and the cup-holder 11A has a rain water drain hole 43 in the floor 44.

Alternatively, as shown in the side view of FIG. 5, the plate-holder may be a planar disc 26 as illustrated. It may have a diameter of at least four inches (4") but preferably six inches (6").

FIG. 4 is a side partial view of the plate-holder 12 and cup-holder 11B of FIGS. 1 and 3.

FIG. 7 is a side partial view of the beverage holder 11A of FIGS. 1 and 6.

It may be further noted that beneath the cup holder 11A or 11B is an integral conically tapered portion 27A or 27B integral with the cup-holder 11A or 11B. Said tapered portion 27A or 27B extends down to a bottom of the respective leg in tapering fashion as shown in FIG. 1.

The stackable chair can be produced in a variety of colors and finishes to suit the range of consumer taste. And, as shown in FIG. 2, the stackable chair 10 is shaped and dimensioned to be stackable to form a stack 100 for storage and transport, each chair nesting easily and securely atop the chair beneath it.

Preferably the stackable chair 10 is dimensioned so that when stacked, there is gap 28 between the front lower edge 29 of the upper adjacent chair and front upper edge 30 of the lower adjacent chair of no more than four inches (4") and preferably of about two inches (2").

The stackable chair 10 of the present preferred embodiment, which is a one-piece, molded plastic patio or lawn chair in which the armrests 17 and 18 have been designed to hold the disposable cups 20A, 20B, and plates 21, presents a number of distinct and significant benefits and advantages. Foremost, the stackable chair 10 offers the same convenience, ease of storage and transport, and minimal expense that have made one-piece, molded plastic outdoor chairs so popular. But the drawback with all such chairs currently on the market, i.e., the lack of a place for food and drink, has been overcome with the design of the stackable chair. The chair does, in fact, hold everything that the outdoor sitter might need at a cook-out or barbecue, a community concert, or a firehouse or church supper because the chair gives the sitter a secure, ample cup-, can-, or bottle-holder 11A or 11B for the cup 20A or 20B in the left armrest 17 or in the right armrest 18; and the secure holder 12 for the paper or plastic picnic plate 21 in the right armrest 18. The chair 10 not only provides a secure place for food and drink, but also is also stackable, for the convenient storage and transport qualities that have made one-piece molded chairs such a favorite. For household consumers, for catering companies, for bars and restaurants with outside seating, for church and community groups, schools, concert venues, the chair will appeal strongly, and very likely become the standard in affordable, stackable, outdoor seating.

The foregoing exemplary descriptions and the illustrative preferred embodiments of the present invention have been explained in the drawings and described in detail, with varying modifications and alternative embodiments being possible. While the invention has been so shown, described and illustrated, it should be understood by those skilled in the art that equivalent changes in form and detail may be made therein without departing from the true spirit and scope of the invention, and that the scope of the present invention. Moreover, the invention as disclosed herein, may be suitably practiced in the absence of the specific elements which are disclosed herein.

I claim as my invention:

1. A stackable chair system, comprising:

a plurality of chairs, each chair having a back, a seat, and first and second armrests all integral with one another in an injection-molded thermal plastic construction;

each first armrest having an integral molded first round non-movable cup-holder positioned in a region of an outer end of the first armrest;

each second armrest having an integral molded second round non-movable cup-holder positioned in a region of an outer end of the second armrest;

each of said respective first and second cup-holders being located in a tapering conically-shaped region which extends down and terminates at a bottom of a respective leg extending down from respective said left and right armrests;

the back, seat, first and second armrests, and first and second cup-holders all being an integral single molded piece;

each seat portion being contoured downwardly forming a seat depression; and each chair being dimensioned so that the chairs can be stacked on top of one another in nested fashion.

2. The system of claim 1 wherein the first armrest is a left armrest and the second armrest is a right armrest.

3. The system of claim 1 wherein the first and second cup-holders are integrally molded directly at an end of the respective first and second armrests.

4. The system of claim 3 wherein the cup-holders are part of a respective tapering conical integral molded portion having a decreasing diameter as it tapers toward a bottom end of a respective leg of the chair beneath the respective first or second armrests.

5. The system of claim 3 wherein a respective central vertical axis of the respective cup-holder is positioned outwardly of a respective longitudinal center line of the first and second armrests.

6. The system of claim 5 wherein said respective central vertical axis is at least one-half (½") inch outwardly of said respective longitudinal center line of said respective first and second armrests.

7. The system of claim 1 wherein each chair comprises a weather-proof UV-resistant material.

8. The system of claim 1 wherein said chairs are dimensioned so that whey they are stacked there is a gap between a front of each seat portion of adjacent chairs of no more than 4 inches.

9. The system of claim 1 wherein each second armrest also has an integral molded plate-holder in a region of an outer end of the second armrest.

10. The system of claim 9 wherein said plate-holder is inwardly spaced from an end of the second armrest and has a central vertical axis which is outwardly of a longitudinal center line of the second armrest.

11. The system of claim 10 wherein the plate-holder has a flat, recessed bottom.

12. The system of claim 9 wherein the plate-holder is a flat, round integral disc.

13. The system of claim 9 wherein the plate-holder is round.

14. The system of claim 1 wherein each chair comprises a weather-proof, UV-resistant material.

15. The system of claim 1 wherein said chairs are dimensioned so that when they are stacked there is a gap between a front of each seat portion of adjacent chairs of no more than 4 inches.

16. A stackable chair system, comprising:

a plurality of chairs, each chair having a back, a seat, and left and right armrests all integral with one another in an injection-molded thermal plastic construction;

each left armrest has an integral molded first round cup-holder for accommodating a cup and is at least 2 inches in depth and positioned such that a central vertical axis of the cup lies at least ½ inch outwardly of a longitudinal center line of the left armrest;

each right armrest has an integral molded second round cup-holder for accommodating a cup and is at least 2 inches in depth and positioned such that a central vertical axis of the cup lies at least ½ inch outwardly of a longitudinal center line of the right armrest;

each seat portion being contoured downwardly forming a seat depression;

each chair being dimensioned so that the chairs can be stacked on top of one another in nested fashion wherein a maximum gap between a front of each seat portion of adjacent chairs when stacked is no greater than four inches; and each of said respective first and second cup-holders being located in a tapering conically-shaped region which extends down and terminates at a bottom of a respective leg extending down from respective said left and right armrests.

17. The system of claim 16 wherein a round plate-holder is provided towards an outer end of the right armrest and integrally molded thereto and having a recessed flat floor having a depth of at least approximately 1 inch for accommodating a food plate, said plate-holder having a central vertical axis being offset outwardly to a right of a longitudinal center line of said right armrest by at least ½ inch, and an edge of the plate-holder nearest a front end of the right armrest is set back from said front end.

18. The system of claim 17 wherein the plate-holder has a rain water drain hole in the flat floor.

19. The system of claim 16 wherein the first and second cup-holders each have a floor with a respective rain water drain hole therein.

* * * * *